US007200969B2

(12) United States Patent
Rotter

(10) Patent No.: US 7,200,969 B2
(45) Date of Patent: Apr. 10, 2007

(54) DOWN SPOUT GUARD MADE FROM NON-WOVEN MATERIAL

(76) Inventor: Martin J. Rotter, 115 Lismore Ave., Glenside, PA (US) 19038

( * ) Notice: Subject to any disclaimer, the term of this patent is extended or adjusted under 35 U.S.C. 154(b) by 317 days.

(21) Appl. No.: 10/920,528

(22) Filed: Aug. 18, 2004

(65) Prior Publication Data

US 2005/0016078 A1 Jan. 27, 2005

Related U.S. Application Data

(63) Continuation-in-part of application No. PCT/US2004/000545, filed on Jan. 12, 2004.

(60) Provisional application No. 60/439,993, filed on Jan. 14, 2003.

(51) Int. Cl.
*E04D 13/00* (2006.01)

(52) U.S. Cl. ..... 52/12; 210/162

(58) Field of Classification Search ..... None
See application file for complete search history.

(56) References Cited

U.S. PATENT DOCUMENTS

| | | | | | |
|---|---|---|---|---|---|
| 316,578 | A | * | 4/1885 | Schumann | 210/162 |
| 520,993 | A | * | 6/1894 | Keller | 210/162 |
| 571,711 | A | * | 11/1896 | Twist | 210/162 |
| 643,747 | A | * | 2/1900 | Martin | 210/481 |
| 737,138 | A | * | 8/1903 | Ralston | 210/162 |
| 803,316 | A | * | 10/1905 | Vogel | 210/162 |
| 901,582 | A | * | 10/1908 | Austin | 405/43 |
| 939,838 | A | * | 11/1909 | Hensler | 210/162 |
| 1,011,669 | A | * | 12/1911 | Temme | 138/32 |
| 1,290,470 | A | * | 1/1919 | Yordy | 210/154 |
| 1,862,134 | A | * | 6/1932 | Boosey | 210/163 |
| 1,973,321 | A | * | 9/1934 | Schultz | 210/163 |
| 2,059,071 | A | * | 10/1936 | Weyand | 210/463 |
| 2,121,613 | A | * | 6/1938 | Schultz | 210/163 |
| 2,210,248 | A | * | 8/1940 | Lighthill | 210/162 |
| 2,461,610 | A | * | 2/1949 | Lord | 52/12 |
| 2,533,402 | A | * | 12/1950 | Schmitz, Jr. | 210/463 |
| 2,640,593 | A | * | 6/1953 | Korb | 210/239 |
| 2,669,197 | A | * | 2/1954 | Van Duzer | 210/162 |
| 2,875,712 | A | * | 3/1959 | Blau | 210/154 |
| 3,121,684 | A | * | 2/1964 | Bugbird | 210/237 |
| 3,409,138 | A | * | 11/1968 | Lawrence | 210/238 |
| 3,507,396 | A | * | 4/1970 | Homa | 210/477 |

(Continued)

FOREIGN PATENT DOCUMENTS

| | | | | |
|---|---|---|---|---|
| JP | 2005256412 | A | * | 9/2005 |
| WO | WO 2004065717 | A2 | * | 8/2004 |

*Primary Examiner*—Robert James Popovics
*Assistant Examiner*—T. Woodruff
(74) *Attorney, Agent, or Firm*—Volpe and Koenig, P.C.

(57) ABSTRACT

A non-woven mesh guard which can be inserted into a downspout opening in a rain gutter in order to prevent debris from entering the downspout is provided. The non-woven mesh includes a large free area to allow for the flow of water therethrough while preventing debris from entering the downspout. Anchor pins are installed in the guard to prevent it from being forced too far down into the downspout opening. Alternatively, the non-woven material may be formed such that it includes an enlarged top portion which rests in the base of the gutter over the downspout opening while a reduced size portion is inserted into the downspout.

17 Claims, 3 Drawing Sheets

U.S. PATENT DOCUMENTS 3,626,542 A * 12/1971 Despain ..... 15/236.04
3,855,132 A * 12/1974 Dugan ..... 210/455
3,947,362 A * 3/1976 Etani ..... 210/416.2
4,190,988 A * 3/1980 Carreiro ..... 52/16
4,247,397 A * 1/1981 Dobosi ..... 210/162
4,253,281 A * 3/1981 Ruttenberg ..... 52/12
4,272,370 A * 6/1981 Cunning ..... 210/162
4,285,812 A * 8/1981 Stoltz ..... 210/162
4,745,709 A * 5/1988 Johnson ..... 52/2.26
4,936,061 A * 6/1990 Palma ..... 52/12
4,949,514 A * 8/1990 Weller ..... 52/12
5,103,601 A * 4/1992 Hunt ..... 52/12
5,107,635 A * 4/1992 Carpenter ..... 52/12
D338,725 S * 8/1993 Trampush ..... D23/261
5,242,591 A * 9/1993 Beechert et al. ..... 210/474
5,302,283 A * 4/1994 Meuche ..... 210/162
5,409,602 A * 4/1995 Sorenson ..... 210/162
5,522,183 A * 6/1996 Allen ..... 52/12
5,535,554 A * 7/1996 Harris Jr. ..... 52/12
5,536,406 A * 7/1996 Silva ..... 210/460
5,592,783 A * 1/1997 Jones ..... 52/12
5,595,027 A * 1/1997 Vail ..... 52/12
D390,924 S * 2/1998 Schlatter ..... D23/267
D395,072 S * 6/1998 Mariani ..... D23/209
5,848,857 A * 12/1998 Killworth et al. ..... 405/118
RE36,343 E * 10/1999 Silva ..... 210/460
5,960,590 A * 10/1999 Hutchison ..... 52/11
6,134,843 A * 10/2000 Tregear ..... 52/12
6,141,916 A * 11/2000 Shackelford ..... 52/12
6,193,880 B1 * 2/2001 Bergeron ..... 210/162
6,223,474 B1 * 5/2001 Kafton ..... 52/12
6,282,845 B1 * 9/2001 Hines ..... 52/12
6,293,054 B1 * 9/2001 Cangialosi ..... 52/12
6,397,526 B1 * 6/2002 Saul et al. ..... 52/16
6,428,693 B2 * 8/2002 Singleton ..... 210/163
6,493,994 B1 * 12/2002 Lucas ..... 52/12
6,598,352 B2 7/2003 Higginbotham
6,652,112 B1 * 11/2003 Lucarelli ..... 362/145
6,932,911 B1 * 8/2005 Groth et al. ..... 210/747
6,944,991 B2 * 9/2005 Kim ..... 52/11
6,986,621 B2 * 1/2006 Allard ..... 405/36
7,051,480 B1 * 5/2006 Dennis ..... 52/24
7,074,326 B2 * 7/2006 Singleton ..... 210/163
2004/0040220 A1 * 3/2004 Baker ..... 52/12
2005/0016078 A1 * 1/2005 Rotter ..... 52/12
2005/0034376 A1 * 2/2005 Pourdeyhimi et al. ..... 52/11
2005/0145560 A1 * 7/2005 Jones ..... 210/459
2005/0178072 A1 * 8/2005 Olthoff ..... 52/12
2005/0247611 A1 * 11/2005 Groth et al. ..... 210/162
2006/0037253 A1 * 2/2006 Mozeika, III ..... 52/12
2006/0117672 A1 * 6/2006 Kurple et al. ..... 52/12
2006/0123710 A1 * 6/2006 Lenney et al. ..... 52/12
2006/0191208 A1 * 8/2006 MacIntyre ..... 52/12

* cited by examiner

DOWN SPOUT GUARD MADE FROM NON-WOVEN MATERIAL

CROSS-REFERENCE TO RELATED APPLICATIONS

This application is a continuation-in-part of International Application No. PCT/US2004/000545, filed Jan. 12, 2004, which claims the benefit of U.S. Provisional Application No. 60/439,993, filed Jan. 14, 2003.

BACKGROUND

Many types of devices are known for preventing rain gutters and down-spouts from becoming clogged with leaves and/or other blown debris.

One known device is formed of a wire mesh which is inserted into the down spout opening of a rain gutter. The wire mesh prevents leaves or other debris from entering the downspout. While this does not eliminate the need to clean gutters, it does prevent downspouts from becoming plugged which can result in gutters overflowing, freezing or leaking back into the soffit under the roof overhang.

It has also been known to cover a rain gutter with a mesh or with a solid sheet material leaving only a small gap at the edge of the gutter for water to enter. While this is somewhat effective, it prevents access for cleaning. Although such products greatly reduce the need for cleaning, it is still inevitable that some debris enters the gutter and that periodic cleaning may be necessary.

It would be desirable to provide a device for preventing downspouts of rain gutters from overflowing which is inexpensively produced, can be easily removed and reinstalled for cleaning and which will not deteriorate quickly based on exposure to moisture, UV radiation and general atmosphere conditions.

SUMMARY

Briefly stated, the present invention provides a non-woven mesh guard which can be inserted into a downspout opening in a rain gutter in order to prevent debris from entering the downspout. Preferably, the non-woven mesh includes a large free area to allow for the flow of water therethrough while preventing debris from entering the downspout. It is also possible to increase the free area for the flow of water while allowing small pieces of debris to be carried out of the downspout through a plurality of small channels extending through the guard. Anchor pins may be installed in the guard to prevent it from being forced too far down into the downspout opening. Alternatively, the non-woven material may also be formed such that it includes an enlarged top portion which rests in the base of the gutter over the downspout opening while a reduced size portion is inserted into the downspout. It is also possible to form a handle directly in the non-woven mesh material which forms the guard to allow for easier gripping for both installation and removal as well as increased penetration area for draining water therethrough.

In another aspect of the invention, a debris shedding fence is anchored to the guard and sits in the rain gutter upstream from the downspout opening. The debris shedding fence prevents large debris from reaching the guard.

BRIEF DESCRIPTION OF THE DRAWINGS

The foregoing summary, as well as the following detailed description of the preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangement shown.

DETAILED DESCRIPTION OF THE PREFERRED EMBODIMENTS

Figure 1:
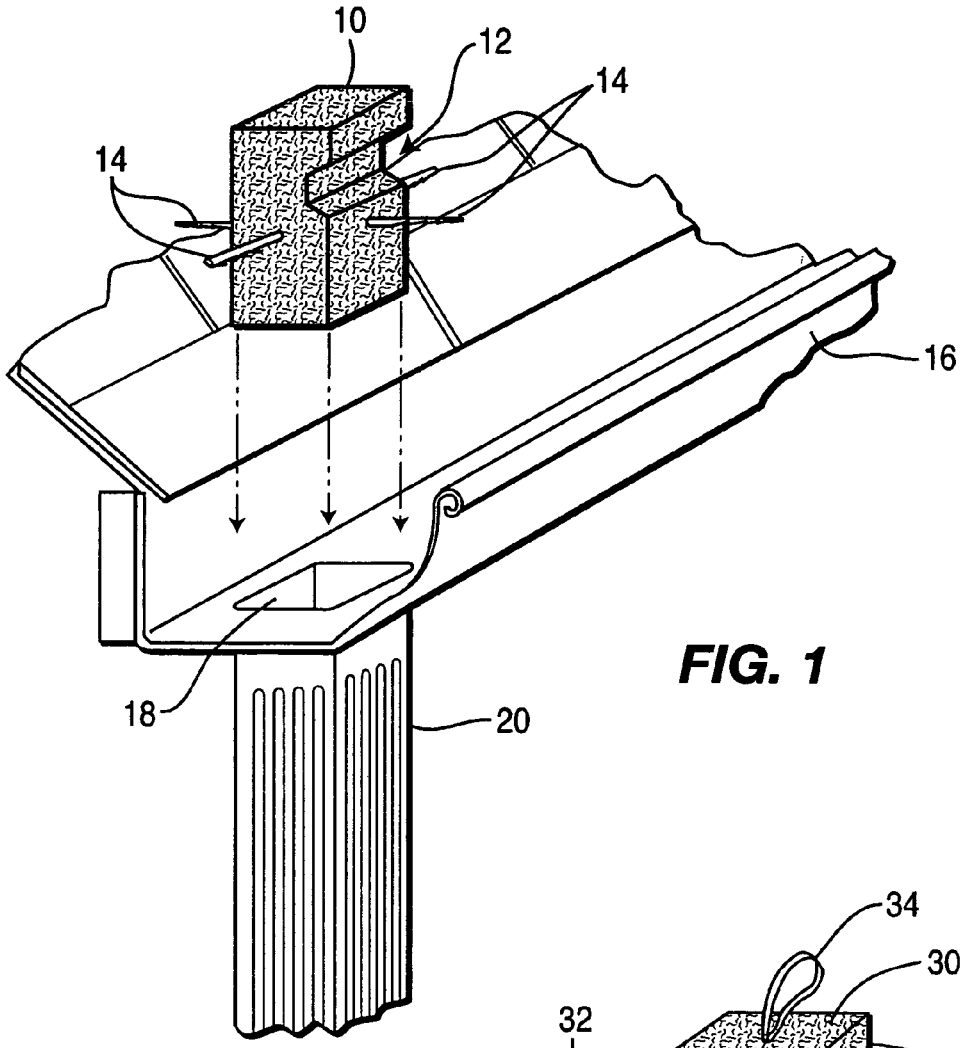
FIG. 1 is a perspective view of a guard in accordance with the invention being installed in a rain gutter downspout.

Certain terminology is used in the following detailed description for convenience only and is not considered limiting. The word "upper" and "lower" designate directions in the drawings to which reference is made. Additionally, the terms "a" and "one" are defined as including one or more of the referenced item unless specifically noted. As used herein, "generally complementary" refers to a shape that generally corresponds to a mating shape, while allowing for the possibility of an interference fit based on the material properties of one or both shapes as well as the possibility of providing void areas within the one shape or along a surface of the one shape at the interface with the mating shape.

Referring now to FIG. 1, a first preferred embodiment of a guard 10 for use in connection with a rain gutter downspout is shown. The guard 10 is formed from a piece of non-woven matting, such as that described in the inventors' prior U.S. Pat. No. 5,167,579, which is incorporated herein by reference as if fully set forth. Other types of non-woven matting may be utilized. However, the matting described in U.S. Pat. No. 5,167,579 has proven successful in outdoor roof ridge vent applications and is resistant to both UV and moisture. The non-woven material has a large net free area of at least 60%, and preferably over 70%, and is formed of filaments which are randomly spun together and adhered in place utilizing an adhesive binder.

In the first preferred embodiment, the guard 10 includes a notch 12 which acts as a handle on an upper portion of the guard 10. Preferably, anchor pins 14 are installed which rest upon the bottom of the rain gutter 16 to prevent the guard 10 from being over-inserted into the opening 18 for the downspout 20. The guard 10 may be made from two pieces of non-woven material which are glued, laminated or otherwise connected together in order to form a guard 10 having a desired thickness. The notch 12 is preferably cut utilizing an abrasive cutting wheel. However, other cutting methods may be utilized in order to form the notch 12. In use, a user would grip the upper portion of the guard 10. The support pins 14 may be pre-installed or installed in position by the user either prior to or after inserting the bottom portion of the guard 10 into the opening 18 for the downspout 20. If the guard 10 needs to be removed for cleaning, it can be gripped by the notch 12 which provides a hand grip area in order to remove the guard 10 from the downspout opening 18. Alternatively, it would be possible to attach a handle or pull string to the top of the guard 10.

Figure 4:
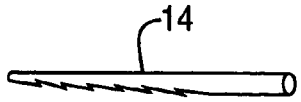
FIG. 4 is a side view of a barbed support pin used in conjunction with the guard shown in FIGS. 1 and 3.

As shown in FIG. 4, preferably the support pins 14 are serrated so that they do not become dislodged from the non-woven material of the guard 10 after they have been installed. Preferably, the support pins 14 are made of copper or stainless steel to resist corrosion. However, other materials may be utilized.

Figure 2:
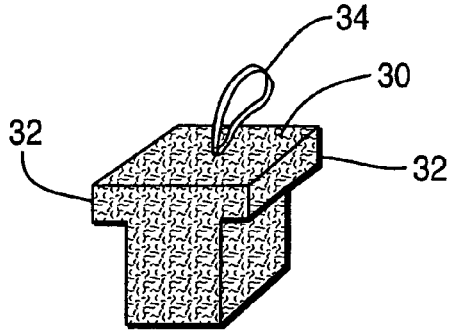
FIG. 2 is a perspective view of a second embodiment of a guard in accordance with the present invention.

Referring to FIG. 2, a second embodiment of the guard 30 is shown. The guard 30 is also made of the non-woven material, as described above, and includes an upper lip 32 on at least one side, and preferably on both sides to prevent the guard 30 from being over-inserted into the gutter. Preferably, a handle 34 is connected to the top of the guard 30. The handle 34 may be a loop of nylon or other suitable material and may be semi-rigid such that the loop extends upward and remains in an open position in order to allow the guard 30 to be removed using an extension pole having a hook without the need for a ladder.

Figure 3:
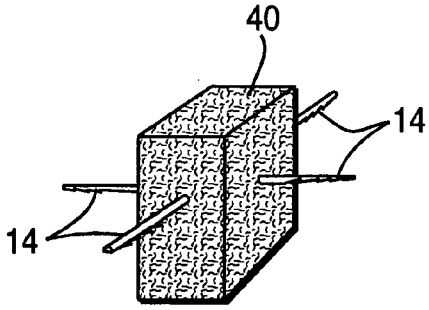
FIG. 3 is a perspective view of a third embodiment of a guard in accordance with the present invention.

Referring to FIG. 3, a third embodiment of the guard 40 is shown. The guard 40 in accordance with the third embodiment of the invention is similar to the guard 10 except that the notch 12 has been omitted.

In the preferred embodiments described above, the lower portion of the guards 10, 30 and 40 are sized to be slightly greater than the opening 18 for a downspout so that they are installed with a slight interference fit. Since the non-woven material utilized to make the guards 10, 30 and 40 is compressible, this insures that the guards 10, 30 and 40 remained anchored in position in the downspouts. The guards 10, 30, 40 are provided in different shapes and sizes that are generally complementary to known gutter/downspout configurations.

Figure 5:
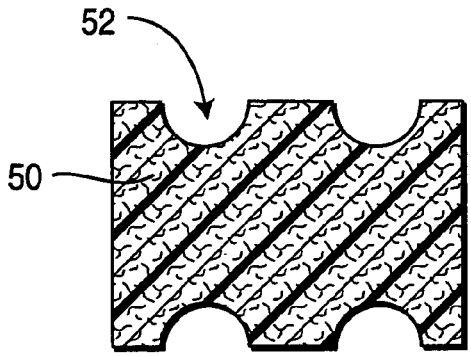
FIG. 5 is a cross-sectional view through a fourth embodiment of a guard in accordance with the present invention.
Figure 6:
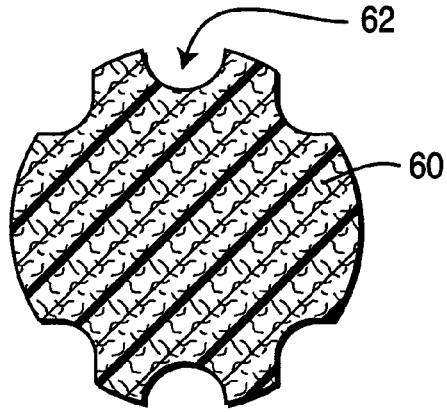
FIG. 6 is a cross-sectional view through a fifth embodiment of a guard in accordance with the present invention.

Referring to FIGS. 5 and 6, additional embodiments of the guards 50 and 60 are shown and can also include one or more channels 52, 62 extending generally longitudinally along the sides of and/or through the guard 50, 60. This allows for an increased volume of water to flow through the guard 50, 60 and down the downspout, and also allows for smaller debris to be carried through the guard and out of the downspout by the water, while preventing larger debris from clogging the downspout. This higher flow through rate of the water also helps to clear small debris from the mesh material. In a preferred embodiment, the combined area of the channel(s) is no larger than about 25% of the cross-sectional area of the downspout. In a more preferred embodiment, the combined area of the channel(s) is between 5% and 20% of the area of the downspout. In the most preferred embodiments, the combined area of the channel(s) is between 10% and 15% of the area of the downspout.

As shown in FIGS. 5 and 6, the channels 52, 62 are located at an outer edge of the guards 50, 60 such that the channels are located against the wall of the downspout. However, it is possible to place the channels through the center of the guard 50, 60, or any other location on the guard 50, 60.

The guards 50, 60 are provided in different shapes and sizes and are generally complementary to known gutter/downspout configurations.

Figure 7:
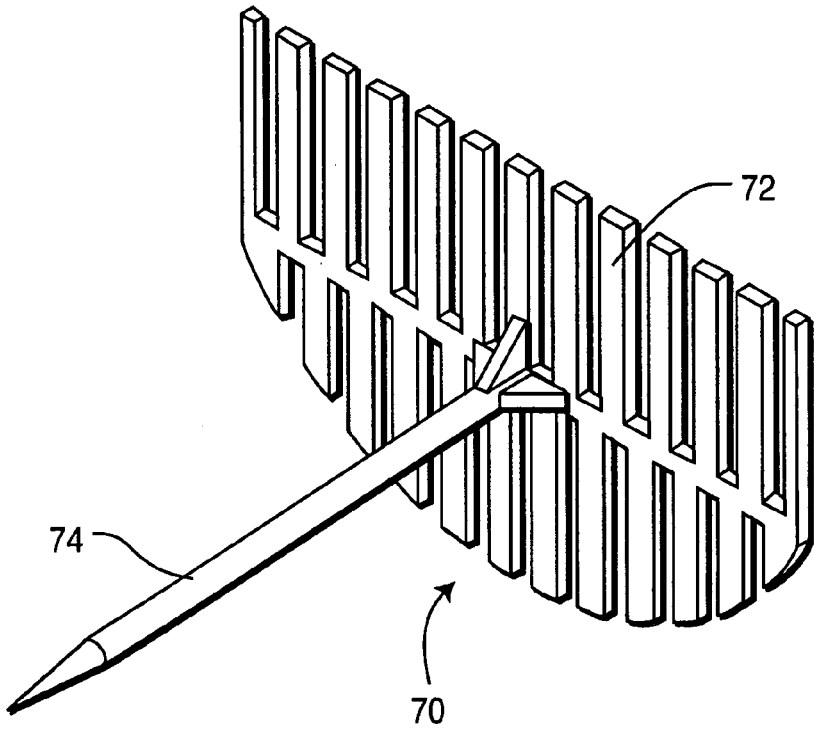
FIG. 7 is a perspective view of a debris shedding fence used in conjunction with the guard shown in FIG. 8.
Figure 8:
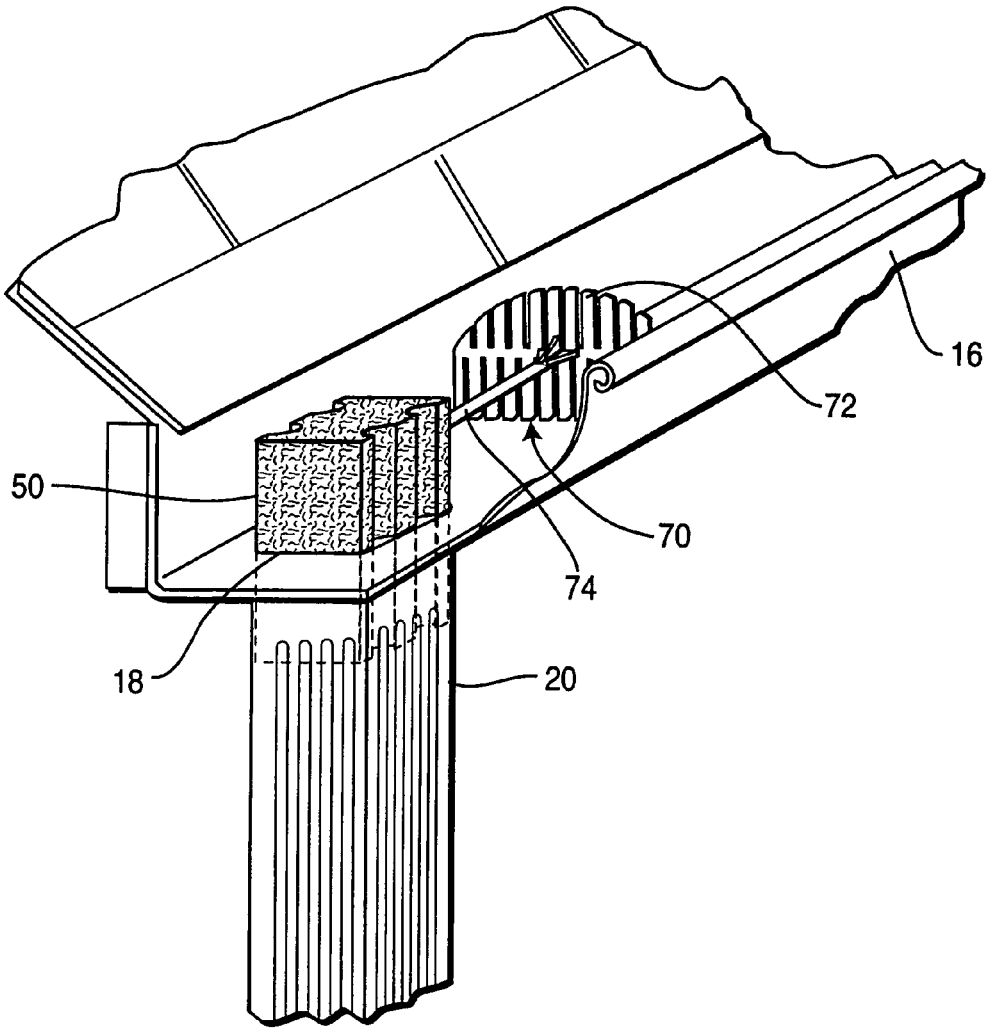
FIG. 8 is a perspective view of the fourth embodiment of the guard in accordance with the present invention installed in a rain gutter downspout and the debris shedding fence installed in the rain gutter.

Referring to FIGS. 7 and 8, an additional embodiment of the invention is shown which utilizes the guard so in combination with a debris blocking/shedding fence 70. The fence 70 has a grid portion 72 and an attachment portion 74, generally in the form of a spike. The fence 70 attaches to the guard 50 by inserting the attachment portion 74 into the portion of the guard 50 which protrudes from the opening 18 of the downspout 20. Once assembled, the grid portion 72 rests in the rain gutter 16 and prevents large debris from reaching the guard 50 in the opening 18 of the downspout 20, while still allowing water and smaller debris to pass through. The fence 70 also allows for debris to spill over the side walls of the rain gutter 16 in the event that too much debris is collected against the fence 70.

While the fence 70 is shown standing generally vertically in the rain gutter 16, in the embodiment shown, it will be recognized by those skilled in the art that the fence 70 can be angled, for example a 60°, in order to further enhance the debris shedding capability of the fence guard 70.

As shown, the fence guard 70 is placed in the rain gutter 16 with its horizontal edge facing down to complement the horizontal floor of the rain gutter 16. The fence guard 70 can also be placed with its curved edge facing down to complement rain gutters with curved bottoms. The grid portion 72 is made such that pieces can be easily broken off as desired to account for varying dimensions in different rain gutter designs. This allows the debris shedding fence 70 to be manufactured as a single item that can then be adapted to any number of various gutter configurations.

The non-woven material utilized to make the guards 10, 30, 40, 50, 60 is provided in large sheets from a webber, and may be formed to a desired thickness and then cut to size utilizing suitable means, such as an abrasive wheel cutter. Multiple pieces of the non-woven material may also be joined together in order to form the required thickness for a guard 10.

As an alternate to the pins 14, which are installed on each of the four sides of the guards 10 and 40, two pins having greater lengths may be utilized that are inserted all the way through the guard such that each pin extends through two opposing sides. Alternatively, the pins 14 can be omitted entirely.

While the preferred embodiments of the invention have been described in detail, the invention is not limited to the specific embodiments described above which should be considered as merely exemplary. Further modification and extensions of the present invention may be developed, and all such modifications are deemed to be within the scope of the present invention as defined by the appended claims.

What is claimed is:

1. In a rain gutter having a downspout, the improvement comprising:

a guard for preventing debris from entering a downspout of a rain gutter, said guard including:

a piece of non-woven material having a cross-section generally complementary to an opening of the downspout and adapted to extend at least partially into the downspout;

an outwardly extending portion for preventing the material from being over-inserted into the downspout opening; and a fence guard having a grid portion resting in the rain gutter and an attachment portion inserted into the non-woven material.

2. The guard of claim 1, further comprising one or more channels extending through the non-woven material.

3. The guard of claim 1, further comprising a handle for removing the guard from an installed position in the downspout.

4. The guard of claim 3, wherein the handle comprises a recess formed in the non-woven material.

5. The guard of claim 3, wherein the handle comprises a loop connected to the non-woven material.

6. The guard of claim 1, wherein the non-woven material comprises a synthetic fiber web treated with at least one binding agent.

7. The guard of claim 1, wherein the non-woven material comprises a synthetic fiber web having at least a 60% net free area.

8. In a rain gutter having a downspout, the improvement comprising:

a guard for preventing debris from entering a downspout of a rain gutter, said guard including:

a piece of non-woven material having a cross-section that is generally complementary to an opening of the downspout and adapted to extend at least partially into the downspout;

one or more channels extending through the non-woven material; and a fence guard having a grid portion resting in the rain gutter and an attachment portion inserted into the non-woven material.

9. The guard of claim 8, wherein the channel(s) have a combined area not greater than about 25% of a corresponding cross-sectional area of the downspout.

10. The guard of claim 8, wherein the combined area of the channel(s) is between 5% and 20% of the cross-sectional area of the downspout.

11. The guard of claim 8, wherein the combined area of the channel(s) is between 10% and 15% of the cross-sectional area of the downspout.

12. The guard of claim 8, further comprising an outwardly extending portion comprised of at least one pin inserted into the non-woven material.

13. The guard of claim 12, wherein the at least one pin includes 4 separate pins.

14. The guard of claim 12, wherein the at least one pin includes a serrated portion for retaining the pin in the non-woven material.

15. The guard of claim 8, further comprising an outwardly extending portion comprised of a shoulder formed in the material.

16. The guard of claim 8, further comprising a handle formed from a recess in the non-woven material.

17. The guard of claim 8, further comprising a handle formed from a loop connected to the non-woven material.

* * * * *